United States Patent [19]

Lawrance et al.

[11] 4,210,512

[45] Jul. 1, 1980

[54] ELECTROLYSIS CELL WITH CONTROLLED ANOLYTE FLOW DISTRIBUTION

[75] Inventors: Richard J. Lawrance, Hampstead, N.H.; John H. Russell, Reading, Mass.

[73] Assignee: General Electric Company, Wilmington, Mass.

[21] Appl. No.: 1,879

[22] Filed: Jan. 8, 1979

[51] Int. Cl.[2] ..... C25B 9/00; C25B 9/04; H01B 1/04; H01M 2/14

[52] U.S. Cl. ..... 204/257; 204/258; 204/279; 204/290 R; 204/294; 429/38; 429/39

[58] Field of Search ..... 204/257, 258, 263–266, 204/279, 269, 270, 290 R, 294; 429/38, 39

[56] References Cited

U.S. PATENT DOCUMENTS

| | | | |
|---|---|---|---|
| 3,530,005 | 9/1970 | Leonard | 429/39 |
| 3,814,631 | 6/1974 | Warszawski et al. | 429/39 |
| 4,039,409 | 8/1977 | LaConti et al. | 204/129 |
| 4,056,452 | 11/1977 | Campbell | 204/258 |
| 4,057,479 | 11/1977 | Campbell | 204/258 |
| 4,124,478 | 11/1978 | Tsien et al. | 204/279 X |

*Primary Examiner*—John H. Mack
*Assistant Examiner*—D. R. Valentine
*Attorney, Agent, or Firm*—I. David Blumenfeld

[57] ABSTRACT

A unique, current conducting, separator element with controlled anolyte flow distribution is incorporated in an electrolysis cell having anode and cathode electrodes bonded to an ion transporting membrane. The current conducting-fluid distributing separator has a plurality of parallel conductive ribs which contact the anode electrode and also define a plurality of fluid distribution channels through which an anolyte such as water, is brought to the electrode and through which gaseous electrolysis products and the spent anolyte are removed from the anolyte chamber. A pressure dropping flow restrictor is provided in the channel inlets to prevent gases generated at the anode from flowing backward and blocking the anolyte distribution inlet manifold. The pressure dropping element can take the form of a restrictor to reduce the dimension of the channel. Alternatively the separator is molded so that the inlets of the channels have a reduced cross section.

10 Claims, 3 Drawing Figures

ELECTROLYSIS CELL WITH CONTROLLED ANOLYTE FLOW DISTRIBUTION

This invention relates to an electrochemical cell for the electrolysis of various anolytes including water, and more particularly, relates to a flow distribution current collecting element which provides for controlled and uniform distribution of the anolyte.

Although the instant invention will be described principally with electrochemical cell for the electrolysis of water it will be understood that the invention is not limited to water electrolysis cells but is applicable for providing controlled anolyte distribution for any electrolysis cell.

A great deal of interest has recently been shown in electrolysis cells which utilize a solid electrolyte. A typical example of a solid electrolyte cell for the electrolysis of water is shown and described in U.S. Pat. No. 4,039,409, assigned to the assignee of the present invention. Typically, such an electrolysis cell includes a solid electrolyte made of a sheet or membrane of an ion exchanging resin in which catalytic particles are bonded or incorporated to the surface of the ion exchanging membranes to form dispersed anode and cathode electrodes. In many instances current conducting and gas distributing screens of niobium, tantalum or titanium are utilized to provide for the current flow into and out of the electrode as well as for distribution of the anolyte over the anode and removal of gaseous electrolysis products and spent anolyte.

It has been found that current collection and fluid distribution in electrolysis cells using hydrated ion exchange membranes with electrodes bonded directly to their surfaces may be most effectively achieved at low cost by replacing the costly screens with current collectors which are molded aggregates of conductive particles such as graphite supported in a resin binder. The current collector-fluid distributors are fabricated with a plurality of parallel ribs extending from the body of the current collector. The ribs contact the electrode at a plurality of points to provide a current collection while at the same time the ribs define a plurality of fluid distribution channel through which the anolyte flows and through which gaseous electrolysis products and spent anolyte are removed. Such current collector-fluid distributors may be made bipolar for use in multicell arrangements by providing such ribs on opposite sides of the collector. By angularly disposing the ribs on opposite sides of the current collector-separator, the ion exchanging membranes in a multicell assembly are always supported by the angularly disposed ribs of two collectors. As a result, support for the membranes is at a plurality of points where the angularly disposed ribs of two collectors intersect. Such a current collector-fluid distribution separator is shown and described in application Ser. No. 866,299 filed in the name of Dempsey et al filed Jan. 3, 1978, and assigned to the General Electric Company, the assignee of the present invention.

In such an electrolysis cell anolyte flows through the distribution channels and comes in contact with the anode bonded to a hydrated ion exchange membrane. Gas is evolved at the anode (oxygen in the case of water electrolysis), and flows down the channel until it reaches the outlet manifold and is removed. Ideally, the evolved gas is uniformly mixed with the anolyte flowing down the channel and is subsequently extracted in an oxygen/water phase separator. It has been found, however, the evolved gases are not always uniformly distributed in the anolyte. Anomalous pressure conditions are those conditions in which the downstream pressure may be higher than the average inlet manifold pressure, i.e. the pressure at the inlets to the fluid distribution channels. As a result, it has been observed that some times the gaseous electrolysis products in the fluid distribution channels flow backwards towards the inlet and block the water inlet manifold. When that occurs the gaseous build up at the inlet blocks the flow of the anolyte and the portion of the membrane located in that vicinity is eventually starved of anolyte. The membrane, being a hydrated ion exchange membrane, dries out, raising the resistance of the membrane thereby increasing the cell voltage required for electrolysis.

Applicants have found, that anolyte starvation due to gas blockage of the inlet manifold may be eliminated and controlled anolyte distribution achieved by introducing a predetermined pressure drop at the inlets of the flow distribution channels. This eliminates or substantially reduces the possibility of the downstream pressure becoming greater than the average inlet manifold pressure thereby avoiding backward flow of the evolved gases and gas blockage of the fluid distribution channels. The additional pressure drop may be introduced by positioning a physical restrictor in each of the distribution channel inlets. This reduces the channel cross section and increases the pressure drop. Alternatively, the current collector-fluid distribution channels are molded with reduced inlet cross sections.

It is therefore, a principal objective of the instant invention to provide an electrolysis cell with controlled anolyte flow distribution.

It is a further objective of this invention to provide a water electrolysis cell with controlled water flow distribution.

Yet another objective of the invention is to provide a water electrolysis cell in which water blockage due to evolved oxygen is avoided.

Other objectives and advantages of the invention will become apparent as the description thereof proceeds.

In accordance with one aspect of the invention, the water electrolysis cell includes a hydrated ion exchange membrane which separates the cell into anolyte and catholyte chambers. Dispersed anode and cathode electrodes are bonded to opposite sides of the membrane. A molded graphite current collector having a plurality of elongated current collecting projections or ribs contact the anode. The rib like projections also form a plurality of fluid distribution channels so that water is distributed over the surface of the anode electrode where it is electrolyzed to evolve oxygen which is transported down the fluid distribution channel and removed from the cell. A pressure dropping restricting member is positioned in the fluid channel inlets to prevent gaseous electrolysis products from backing up into the inlet portion of the channels and into the inlet manifold. Controlled water flow distribution is thereby maintained and the possibility of increases in cell voltage and membrane resistance due to water blockage is eliminated or minimized.

The novel features which are believed to be characteristic of the invention are set forth with particularity in the appended claims. The invention itself, however, both as to its organization and method of operation, together with further objectives and advantages thereof, may best be understood by reference to the following description taken in connection with the accompanying drawings in which:

Figure 1:
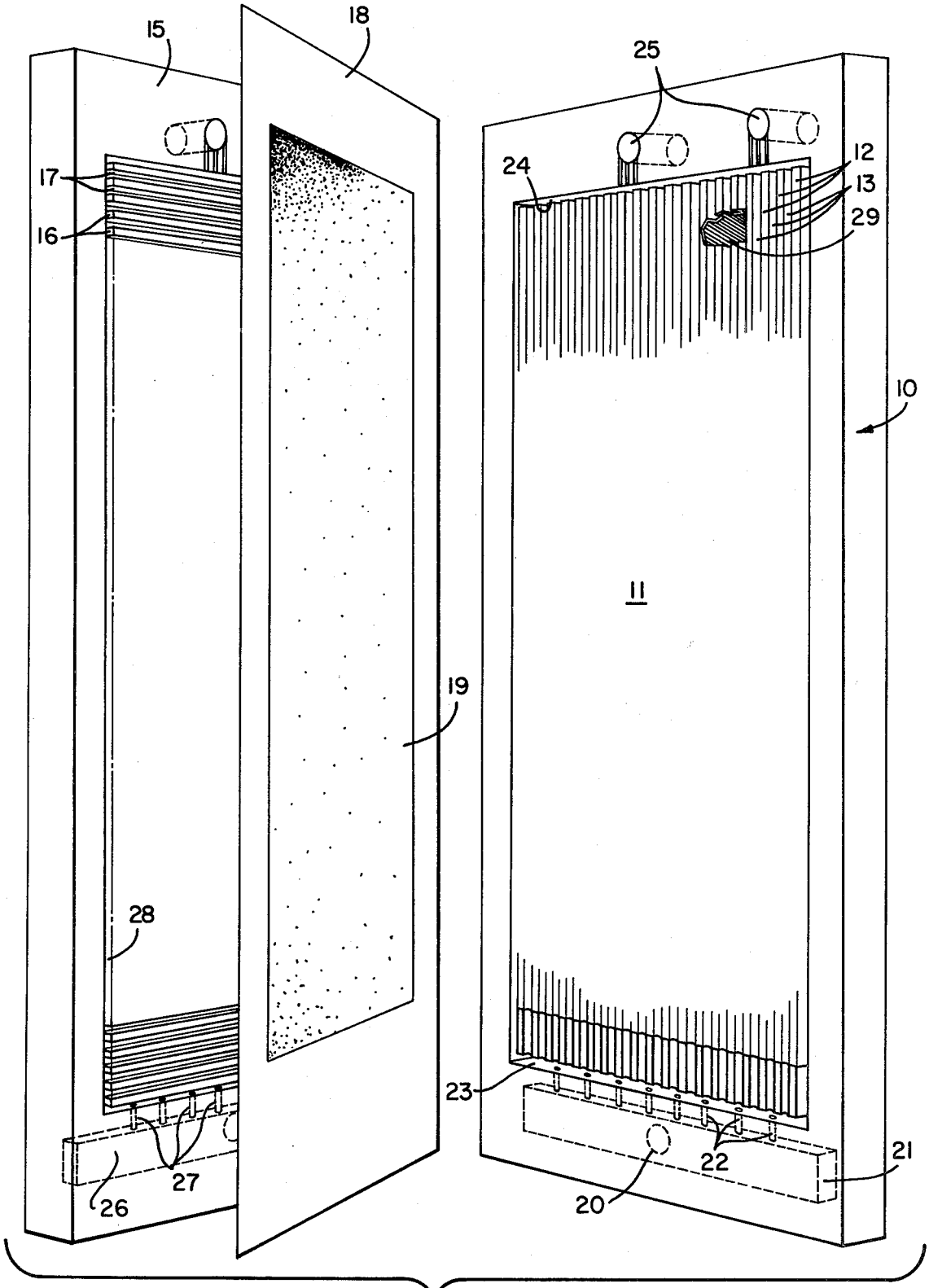
FIG. 1 is an exploded view of a single cell unit utilizing the current collecting/separating element of the invention.

FIG. 1 is an exploded perspective view of an electrolysis cell. The cell includes a hydrated ion transporting membrane having catalytic electrodes bonded to its surfaces. The membrane is disposed between anode and cathode current conducting-fluid distribution plates which include a plurality of conductive ribs extending from a main body. The ribs contact the electrodes bonded to the ion transporting membrane for current collection and also form a plurality of fluid distribution channels through which anolyte and catholyte are brought into contact with the electrodes. Thus, the water electrolysis cell assembly illustrated in FIG. 1 includes a molded graphite current collector and flow distributor element 10 having a central anode chamber 11 and a plurality of parallel ribs 12 extending vertically along the full length of chamber 11. Ribs 12 establish a plurality of fluid distribution channels 13 (see most clearly in FIG. 2) through which the water anolyte passes and through which the oxygen evolved at the anode, is removed. The assembly also includes a current collector-fluid distributor 15 which has a recessed central cathode chamber 16. A plurality of electrode contacting current collecting ribs 17, which are angularly disposed to those in the anode current collector, extend the length of cathode chamber 16. Cathode current collector ribs 17 are shown as horizontally disposed although the angle between the cathode and anode current conducting ribs may be at any angle greater than 0°.

A hydrated ion transporting membrane 18 which is capable of transporting ions has layers of catalytic particles bonded to opposite surfaces thereof to form the anode and cathode. Membrane 18 is disposed between current collectors 10 and 15. Anode 19, which may typically be a bonded mixture of a noble metal catalyst such as platinum, iridium, or reduced oxides of platinum-iridium or reduced oxides of platinum-ruthenium, etc. and hydrophobic fluorocarbon particles, is bonded to one surface of membrane 18. A cathode electrode, not shown, consisting of electrolytic particles such as platinum black, or platinum-iridium, platinum-ruthenium or reduced oxides thereof, etc., is bonded to the other side of the membrane.

The ion transporting membrane is preferably a hydrated permselective cationic membrane. Perfluorocarbon sulfonic acid polymer membranes such as those sold by the Dupont Company under the trade designation "Nafion" may be readily utilized. Permselective cationic membranes in which carboxylic acid radicals are the functional groups may be utilized with equal facility.

The anolyte, such as water in the case of water electrolysis, is brought into anode chamber 11 through an inlet passage 20 which communicates with chamber 21 in the bottom of anode current collector-fluid distributor 10. A plurality of vertical passages 22 extend from chamber 21 open to a horizontal channel or manifold 23 which extends along the bottom of the anode chamber. Channel 23 is open to the vertical flow channels 13 which are formed by the current collector ribs. The anolyte is brought into chamber 21 under pressure and passes into horizontal manifold 23 and thence into the fluid distribution channels 13. The fluid distribution channels 13 open into a upper horizontal manifold 24 which communicates with anode outlet conduits 25 extending through the body of the current collector. In a similar fashion catholyte (although not in water electrolysis) may be brought into a plenum 26 extending across the bottom of the cathode current collector. Plenum 26 communicates through a series of vertical passages 27 with a vertically extending channel or manifold 28 which communicates with the horizontal catholyte distribution channels 17.

Since the current collector-fluid distributors are molded aggregates of carbon or graphite and a resin binder some measure must be taken to protect the graphite or carbon from oxygen evolved during water electrolysis. In the water electrolysis cell of FIG. 1, the anode side current collector ribs etc., are covered by a conductive foil which prevents oxygen evolved at the anode from reaching the graphite. To this end, the anode current collector is covered by a thin conductive foil 29 shown partially broken away in FIG. 1. Foil 29, which has suitable adhesive on one side is forced against the current collector under pressure and heat and conforms to the rib like contour of the current collector. The protective foil must be conductive and should have a non oxide forming surface film since most metallic oxides are poor conductors. The anode protective foil is a thin platinized tantalum or niobium foil. The non oxide forming film is a platinum or other non-oxide forming platinum group metal film which may be electroplated, sputtered, or otherwise deposited on the foil. A loading of 1.6 mg of the platinum group metal per square inch (1.6 mg/in$^2$) is adequate.

In water electrolysis the water anolyte passes into the fluid distribution chambers 11 and comes into contact with the anode electrode which is connected to positive terminal of a suitable source of power, not shown, so that the water is electrolyzed at the surface of the electrode as it passes down the fluid distribution channels. Oxygen is evolved and hydrogen ($H+$) ions are produced at the anode. The $H+$ ions are transported across the cationic membrane to the cathode bonded to the opposite side of the membrane. The $H+$ ions are discharged at the cathode to produce gaseous hydrogen.

As has been pointed out previously, during electrolysis the evolved oxygen passes upwardly through the fluid channels to the outlet conduit. Under some conditions (which are believed most likely to occur at the high current densities with rapid gas evolution) the evolved oxygen rather than being uniformly mixed with the water passing through the channels forms discrete gas layers which alternate with water layers so that the fluid passages are filled with alternate layers of gas and water. With this form of gas water distribution, i.e. with a plurality of gas and liquid interfaces, the pressure along one or more of the fluid distribution channels may instantaneously be higher than the average inlet water manifold pressure. As a result oxygen evolved at the inlet portion of the channels may see a higher pressure downstream than at the inlet manifold. This forces the evolved gas backwards into the manifold blocking the inlet to the fluid channels preventing water or other anolyte from entering channels Eventually the water contained in the channels is consumed. Since the gas bubbles at the inlet block additional water flow into the channel, the membrane dries, raising the resistance of the membrane and increasing the cell electrolysis voltage.

Figure 2:
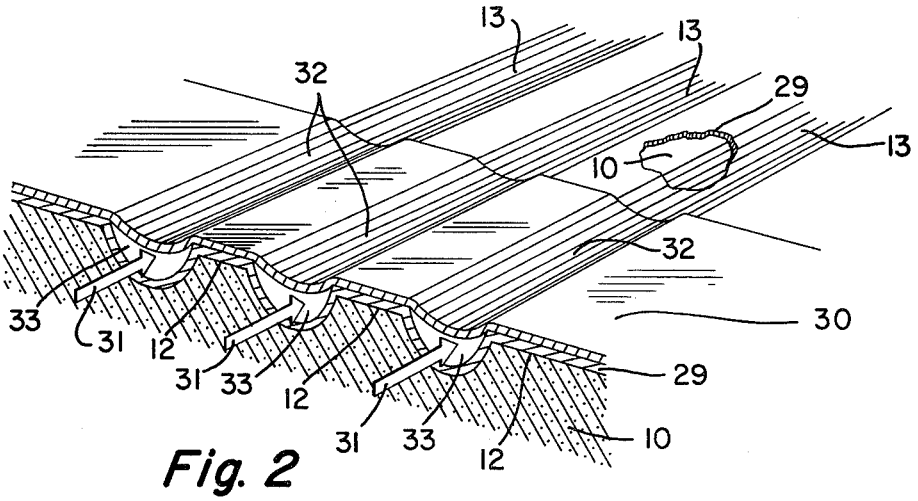
FIG. 2 is a partially broken away perspective of the current collector-fluid distributor fluid restrictors in the channels.

In order to avoid transport of evolved gas toward the inlet manifold and to provide controlled water flow distribution over the surface of the electrode and the membrane at all time, a means is provided at the fluid distribution channel inlets for introducing a predetermined pressure drop. To this end a restrictive element 30 is positioned at the inlet of the fluid channels which reduces the cross section of the fluid channels and thereby introduces an additional drop which is designed to be larger than any anomalous pressure variations which might occur downstream in the fluid channels. This eliminates or minimizes the possibility that evolved oxygen will be forced backward into the inlet manifold thereby blocking further flow of the water into the channels. FIG. 2 illustrates, in detail, the manifold side of the current collector-fluid distributor with the pressure dropping restrictor. Thus, the bonded graphite and resin aggregate is shown as having a plurality of ribs 12 which define a plurality of fluid distribution channels 13. The molded graphite current collector-fluid distributor 10 is covered by a protective metallic foil 29 which prevents the evolved oxygen from attacking the graphite current collector. Foil 29 is preferably the platinized titanium foil described previously.

The water anolyte enters the fluid distribution channels 13, as illustrated by the arrows 30. The anode electrode bonded to the cation transporting membrane, not shown in FIG. 2, is in direct contact with the foil covered rib surfaces 12 to permit current flow between the electrodes and the current collectors. The water passing through passages 13 comes into contact with the electrode causing the water to be electrolyzed and producing evolving oxygen and producing hydrogen ions to the surface of the electrode.

A restrictor 30 formed of a corrosion resistant material is positioned over the near end, which represents the inlet end, of the current collector fluid distributor. Restrictor 30 has a plurality of depressions 32 which generally conform to the shape of the fluid distribution channels and intrude into the channels to form a plurality of restrictive inlet fluid distribution channels 33. As may be seen the cross sections of inlet fluid distribution channels 33 are much smaller than those of the main fluid distribution channels 13. As a result the pressure drops along the length of the restrictor is greater than for an equivalent length of the main channel. The dimension of the restricted channel 33 are such that the pressure drops through the restrictor is sufficient that under normal circumstances even if pressure anomalies occur downstream they will not be sufficient to force the gas back through the restrictor.

Figure 3:
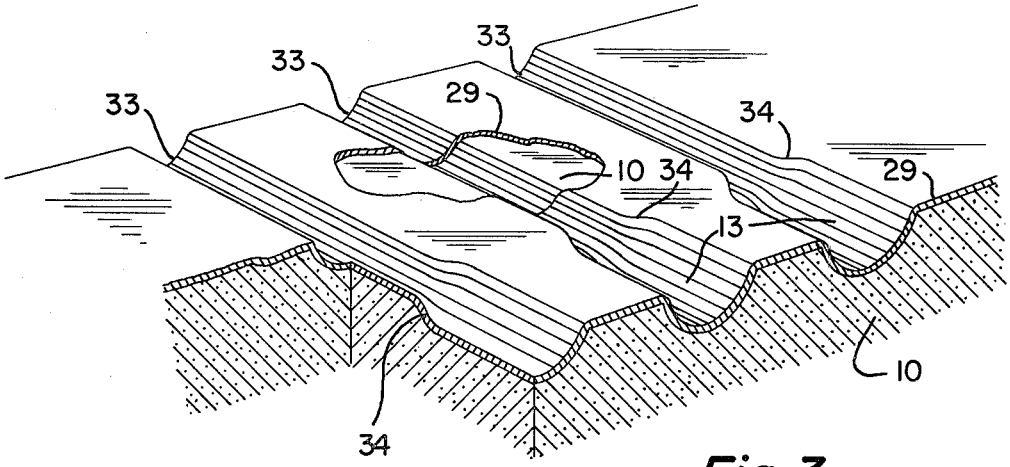
FIG. 3 is a further partially broken away perspective showing an alternative construction.

FIG. 2 illustrates an arrangement in which a restrictor is inserted into the channels. Alternatively, the separate restrictor illustrated in FIG. 2 may be dispensed with an the collector-fluid distributor may be so configured that the inlet side of the fluid distribution channels is smaller than the remainder of the channel thereby achieving the same results. FIG. 3 illustrates such a construction. Thus the current collector 10 is again covered by a thin protective foil 29 and has a plurality of main fluid distribution channels 13 through which an anolyte such as water flows and comes into contact with the anode bonded to a cationic membrane. The current collector however, contains restricted channel portions 33 which are of a smaller cross section than the main fluid distribution channels. The reduced inlet portion extend for a predetermined distance and then widens at 34 into the main channel. The oxygen or other gaseous electrolysis product evolved at the anode faces a restricted passage 33. Because of the additional pressure drop across the restricting section 33 it is highly unlikely that any evolved gas will be forced backward into the anolyte manifold and eliminate or substantially diminishes the possibility of blockage of the inlet to the fluid distribution channel.

It will be obvious from the foregoing that a simple and effective means has been provided to maintain the controlled flow distribution in an electrolyzer of the type having an ion exchange membrane with an anode bonded thereto and ribbed current collecting fluid distribution element contacting the electrode.

While the instant invention has been shown in connection with certain preferred embodiments thereof, the invention is by no means limited thereto since other modifications of the instrumentalities and construction may be made and still fall within the scope of the invention. It is contemplated by the appended claims to cover any such modifications as fall within the true spirit and scope of this invention.

What is claimed as new and desired to be secured by a Letter of Patent of the United States is:

1. In an electrolytic cell, (a) an anode compartment, (b) a cathode compartment, said compartment being separated by an ion permeable, liquid impervious, membrane, (c) an anode electrode bonded to one side of said membrane, (d) a cathode electrode bearing against the opposite side of said membrane, (e) means for establishing an electrical potential between the anode and cathode electrode, said means comprising a conductive member contacting said cathode and a plurality of spaced, elongated anode conductors contacting said anode defining a plurality of fluid transporting channels for movement of anolyte and gaseous electrolysis product, therealong, (f) means communicating with each of said channels to introduce anolyte to the inlet portion of each of said channels, (g) means for providing controlled anolyte distribution across the surface of said anode and along each of said individual fluid transporting channels including means for preventing gaseous electrolysis products from blocking the inlet of any of the individual ones of said channels by introducing a predetermined pressure drop at the inlet thereby maintaining pressure at the inlet of such individual channel higher than the pressure along the remaining length of each such individual channels.

2. The electrolytic cell according to claim 1 wherein inlets of individual channels include pressure dropping means.

3. The electrolytic cell according to claim 2 wherein a restricting means is positioned in said channel inlets.

4. The electrolytic cell according to claim 2 wherein said channel inlet cross section is less than that of the remaining portion of said channel.

5. The electrolytic cell according to claim 2 wherein said plurality of spaced, elongated anode conductors are molded aggregates of conductive graphite particles.

6. The electrolytic cell according to claim 4 wherein said plurality of spaced, elongated anode conductors are covered by a protective current conductive foil which is resistant to the gaseous electrolysis product.

7. The electrolytic cell according to claim 6 wherein said protective foil is covered by a non-oxide forming layer of a platinum group metal.

8. The electrolytic cell according to claim 2 wherein the conductive member bearing against said cathode comprises a plurality of spaced, elongated conductors providing a plurality of fluid transporting channels.

9. The electrolytic cell according to claim 8 wherein the spaced, elongated cathode conductors are aligned at a transverse angle with respect to the anode conductors.

10. The electrolytic cell according to claim 9 wherein said spaced, elongated anode and cathode conductors are molded aggregates of conductive graphite particles and the anode conductors are covered by a protective foil having a non-oxide forming layer of a platinum group metal.

* * * * *